US006460236B1

(12) United States Patent
Müller et al.

(10) Patent No.: US 6,460,236 B1
(45) Date of Patent: Oct. 8, 2002

(54) APPARATUS FOR PRODUCING WRAPPED SLIP TUBES

(75) Inventors: Klaus Müller, Aarburg; Juan Torre, Kindhausen; Paul Kasper, Wohlen, all of (CH)

(73) Assignee: Tormec AG, Dietikon (CH)

( * ) Notice: Subject to any disclaimer, the term of this patent is extended or adjusted under 35 U.S.C. 154(b) by 0 days.

(21) Appl. No.: 09/768,814

(22) Filed: Jan. 23, 2001

(30) Foreign Application Priority Data

Jan. 28, 2000 (EP) ..... 00101809

(51) Int. Cl.[7] ..... B23P 23/00; B21C 37/12

(52) U.S. Cl. ..... 29/33 D; 72/49; 72/50

(58) Field of Search ..... 29/33 D, 33 T, 29/509, 243.58, 521; 72/49, 50, 137, 75, 135; 159/195

(56) References Cited

U.S. PATENT DOCUMENTS 3,940,962 A * 3/1976 Davis ..... 72/50
4,336,702 A * 6/1982 Amado, Jr. ..... 72/75
4,567,742 A * 2/1986 Castricum ..... 72/50
4,679,391 A * 7/1987 Tizzi ..... 72/137 X
5,468,322 A * 11/1995 Menzel ..... 156/195
5,737,832 A * 4/1998 Bubb ..... 29/781

FOREIGN PATENT DOCUMENTS

| | | |
|---|---|---|
| DE | 1246651 | * 8/1967 |
| DE | 1452324 | * 11/1968 |
| DE | 2017383 | * 10/1971 |
| WO | 9817412 | * 4/1998 |

* cited by examiner

*Primary Examiner*—William Briggs
(74) *Attorney, Agent, or Firm*—Martin A. Farber

(57) ABSTRACT

An apparatus for producing wrapped slip tubes from ribbon material (3), which consists of metal at least in part, comprising a profiling device (4) for forming seam edges (3*a*, 3*b*) of the ribbon material (3), at least one guiding surface (6*a*) for guiding the ribbon material (3) provided with the seam edges (3*a*, 3*b*), a bending device for deforming the ribbon material (3) into a helical partial surface of a cylindrical shell by of a deforming surface (7), a seam closing device (12) for closing the seam edges (3*a*, 3*b*) when inserted into one another by pressing them together, and a cutting device (15) for cutting produced tube portions off. Since the deforming surface (7), and preferably the at least one guiding surface (6*a*) also, comprises a contact surface of plastic material, pollution and damages of the tube can be avoided when producing it.

12 Claims, 2 Drawing Sheets

APPARATUS FOR PRODUCING WRAPPED SLIP TUBES

For producing wrapped slip tubes or spiral pipes from ribbon material that consists of metal at least in part, apparatuses are used comprising a profiling device, a bending device and a seam closing device. The profiling device forms matching seamed edges or brims of the ribbon material which, after deformation of the ribbon material in bending direction, are mutually inserted, and are pressed together by the closing device, that has cooperating closing wheels, to form a folded seam connection. The ribbon material engages helically a cylinder surface by a deforming surface in bending direction, the partial surface of a cylinder periphery, thus created, being called helical. For interconnecting the seamed edges, preferably a simple rim is inserted into a double rim, and subsequently these rims, which project from the outer surface of the tube, are closed and are preferably pressed against the outer surface of the tube. The folded seam connection extends helically about the wrapped slip tube thus produced. In order to be able to produce tube sections of a desired length, a cutting device, for example a rotating cutting-off disk or rotary shears, have to be provided.

From U.S. Pat. No. 4,567,742 an apparatus is known in which the metal ribbon is drawn by a pair of rolls through an arrangement of profiling rolls for forming the lateral edges or beads and for forming at least one stability increasing longitudinal fold, and is introduced into a bending and closing device having helical deforming surface and cooperating closing rolls. Between the pair of drive rolls and the bending and closing device, guide plates having longitudinal grooves for the edges and longitudinal folds of the ribbon material are used. As the guide plates, the deforming surface too is provided with grooves for the longitudinal folds. In order to be able to produce wrapped slip tubes of different diameter, the whole bending and closing device would have to be exchanged. If an apparatus according to U.S. Pat. No. 4,567,742 had to be used for producing tubes of a plurality of different diameters, a complete bending and closing device would have to be prepared for each diameter which requires much space for storing all bending and closing devices. Particularly in the case of large tube diameters, these bending and closing devices are heavy and cumbersome, and thus awkward when exchanging them. Also in solutions with curving or bending devices separated from the closing device, the deforming surfaces are often formed as heavy heads cast from aluminum.

An important disadvantage of this solution resides in that the intensive frictional contact of the ribbon material with the metal guide plates and the metal deforming surface results in wear of the guide and deforming surfaces as well as of the ribbon material. The ribbon material is subjected to an intensive frictional contact, and corresponding wear, also when passing the drive and/or profiling rolls. Wear of the metal results in optical spoiling of the surface of the produced wrapped slip tube. In addition, at least with zinc coated ribbon material, metal dust can be softened due to heat generated by friction and deposited, for example, on the closing rolls which affects the function of the rolls and increases maintenance expenditure. Also with ribbon material that is coated with plastic material, friction and heat result in undesirable damaging the tube's surface and in adhering of coating material on the guide and deforming surfaces as well as on the closing rolls. In order to reduce wear and heating, parting oils in the form of water mixable cooling lubricants with combinations of mineral oils, emulsifying agents and other additives are used. A parting agent on the market is available under the trademark BLASOL-UBE. In order to reduce friction, this parting agent is used in excess or as a bath so that the tube, thus created, entrains large quantities of parting agent out of the forming apparatus which results in pollution and/or higher expenditure for cleaning.

When ribbon material, coated with a white plastic material or consisting of polished stainless steel, is moved over guide and deforming surfaces that are of brass at least in part, brass dust causes clearly visible blackish spots on the wrapped slip tube. To clean these spots away using rags and a cleaning agent, excessive expenditure would be necessary. If, however, the dark spots remain on the tube, they affect the appearance of the tube which is undesirable on aerating tubes, for example, which are visibly mounted below a ceiling. Apart from the aesthetic spoiling, any damage of the plastic coating can lead to oxidation of the sheet metal protected by the plastic coating. Also if the ribbon material is uncoated, wear can result in an undesirable appearance and/or oxidation. Even on a ribbon of stainless steel, metal dust of the guide and deforming rolls can oxidize on the wrapped slip tube. For instance, the luster or a protecting oxide layer of the ribbon material can be affected by friction between the two metal surfaces. Accordingly, the aesthetic effect or the protection of the wrapped slip tube is diminished.

Apart from the problems resulting from wear, scobs or other solid particles getting between the guide surfaces and the ribbon material lead to faults or scratches on the surface of the wrapped slip tube. Particularly, if a cutting-off wheel is used as a cutting device, scobs will be generated when cutting a tube section off. Even if the cutting device does not produce scobs, an apparatus for producing wrapped slip tubes is often in a room where scobs are produced by other machines. Therefore, any scratching effect of such scobs on the wrapped slip tubes should be kept as little as possible.

DE 1 246 651 discloses an apparatus for producing wrapped slip tubes in which the deforming surface is extremely complicated in order to reduce friction between the ribbon material and the deforming surface. Four supporting plates are perpendicularly connected between two bearing plates. Each supporting plate supports 10 lamina of plastic material whose free surface areas form partial areas of a cylindrical deforming surface. These lamina have to have concave surfaces and to be mounted precisely to the bearing plates. Since the bearing plates are perpendicular to the axis of the tube to be produced, the lateral edges of the ribbon material supplied transversely to the axis and the closed folded seam connections extend transversely to the bearing plates and, thus over individual lamina, the lamina concerned being worn more severely than others. When introducing the front end of the ribbon material, its leading edge abuts laterally against the lamina which may result in damaging the lamina. Due to wear and damage, individual lamina have to be replaced again and again which involves undesirable high expenditure. In addition, the bearing plates have to be exchanged with high mounting expenditure whenever the diameter of the tube to be produced changes.

DE 2 017 383 describes an apparatus for producing wrapped slip tubes in which a closed plastic ribbon, running with the ribbon material, is arranged between the deforming surface and the ribbon material to prevent scratching of the tube's outer surface. The arrangement of rolls for guiding the endless ribbon is expensive and liable to failure. In addition, this solution is not suitable, if spiral tubes of different tube diameter are to be produced. From U.S. Pat.

No. 3,940,962, a solution is known in which plastic coatings are provided on flat guide plates so that the ribbon material can be supplied to the deforming surface under reduced friction. For deforming the ribbon material, rolls are used. The expenditure for introducing the front end of the ribbon material and for changing the tube's diameter by changing the positions of the rolls is high. Although friction of the rolls is reduced due to the rolling motion, undesirable faults of the surface of the wrapped slip tube will occur nevertheless due to scobs or other solid particle getting between the rolls and the ribbon material.

U.S. Pat. No. 5,737,832 describes a method for producing wrapped slip tubes from a plurality of overlapping strips of ribbon material by a conventional deforming head. In order to prevent an undesirable deformation of the strips of ribbon material when initially bending them, it is suggested to provide guide plates of plastic material in the entering region of the deforming head. In the major part of the deforming surface, faults of the wrapped slip tube surface due to friction or scobs or other solid particles cannot be prevented. In order to be able to produce wrapped slip tubes of different diameters, the whole deforming and closing device, which is extremely massive, has to be exchanged which involves an undesirably high expenditure.

SUMMARY OF THE INVENTION

It is, therefore, an object of the invention to provide an apparatus for producing wrapped slip tubes of different diameter, and a bending device for it which are simple in construction and, in the case of ribbon material which is coated or has a sensitive surface, reduces undesirable pollution or damage.

Within the scope of the present invention, it has been recognized that metal dust can decisively be reduced if at least the deforming surface, and preferably also the guide surface, comprises a contact surface of plastic material. To this end, the deforming surface, and preferably also at least one guide surface, can be coated or produced from plastic material. The object according to the invention is attained by ribbon-shaped deforming surfaces having a contacting surface of plastic material. They are simple to exchange and may be provided for all tube diameters possibly required. Only small space is needed for storing ribbon-shaped deforming surfaces or forming ribbons. The preferred forming ribbons comprise a metal ribbon of spring steel coated with antifriction plastic material. In some cases, forming ribbons of plastic material, particularly of a monoplastic or a composite plastic material, are used. Composite materials comprise preferably glass fibers or carbon fibers.

When using a plastic coating, an extremely stable connection has to be made between the, preferably metal, bearing part and the coating. To this end, special adhesives which adhere particularly well to metallic surfaces can be used and/or an adhesiveness raising surface treatment of the bearing part can be performed. In suitable surface treatments, a roughening step is preferably effected by grinding and/or sandblasting. The plastic materials suited for coating have to ensure small friction coefficients in cooperation with the surface of the ribbon material. Such antifriction plastic coatings can be made, for example, of polyamide, particularly polyamide 11 (trademark RILSAN), or polyethylene, particularly of a PE ionomere (trademark Abcite) or chlorine trifluorethylene (CTFE), particularly E-CTFE (trademark HALAR). It is to be understood that other antifriction coatings, particularly teflon-like polytetrafluorethylene (PTFE) or polyperfluorethylene-propylene (T.FEP), can be used. The thickness of the plastic coating used is preferably in the range of 0.1–0.8 mm, and particularly in the range of 0.20–0.4 mm. Using coating thicknesses within these ranges, it can be ensured that the coated contact surfaces attain sufficiently long working times up to a complete wear of the coating. In some cases, worn off forming ribbons are coated anew with plastic material which can be effected with sensible expenditure and results in a minimum material consumption. Since metal dust is disturbing mainly with tubes that are either coated or consist of polished stainless steel, the use of coated forming ribbons can be restricted to these tubes. These specially sensitive tubes amount only to about 5–10% of the total production of a tube manufacturer. Therefore, the time of use of coated deforming surfaces or forming ribbons is relative short so that these coated forming ribbons need not to be replaced often. When processing zinc coated ribbon material, uncoated deforming surfaces may be used, because zinc undergoes an after-passivation at the damaged places. Moreover, scratches, due to forming flowers of zinc, are less visible on zinc coated material.

With today's plastic material and shaping methods, forming ribbons, and preferably the guide surfaces too, can completely be produced of plastic material. To this end, both single-component parts, particularly from the above-mentioned antifriction plastic materials, and composite parts of different plastic materials are possible. In the case of composite materials, at least one fibrous material, particularly glass or carbon fibers, are used, for example for achieving high tensile strength. The fibrous material may be employed, e.g. as a reinforcement in an extruded or molded plastic part. In some cases, however, the fibrous material is used for manufacturing a yarn and then of a tissue. The tissue, in turn, may be employed as a reinforcement in a plastic part. Optionally, the tissue is coated with antifriction plastic material or is used directly as a forming ribbon. Plastic parts have less weight in comparison with coated metal parts. If the deforming surface of the bending device is not a rigid one, deformation motions, when changing the deforming surface, will lead to a lesser extent of damages or cracks in the case of a plastic part than in the case of a plastic coated metal part. Therefore, forming ribbons are advantageous which are substantially made of plastic material only.

If the forming ribbon, and optionally the guide surface too, comprises a contact surface of plastic material, no metal dust will be produced when the ribbon material moves along the contact surface. Plastic particles rubbed off in some cases is not dark and causes no oxidation. In addition, the surface of the ribbon material is prevented from being damaged. When plastic contact surfaces are used, the scratching action of scobs is also reduced, because scobs can be taken into the plastic material. Due to better sliding properties of plastic contact surfaces, it is even possible to use different lubricant. In particular, very small quantities of the lubricant, preferably in the form of a creep oil, may be applied so that neither the tube nor its ambiance are perceivably soiled. Preferably, a heavy duty cutting oil is used which comprises a mixture of mineral oil and hydrocarbon and, particularly, an ester. The lubricant available on the market under the name ISOLUBE is suitable to be applied.

The lubricant is not used in the form of a bath, but is preferably applied onto the surface of the ribbon material by an application sponge. Application is at least effected before deforming the ribbon material by means of the forming ribbon, but preferably already prior to profiling the ribbon material. To this end, the application device for applying the lubricant is preferably constructed in such a way that scobs are retained and cannot get between the ribbon material and an engaging contact surface. If a vaporizing lubricant is used, substantially no residues will remain on the tube.

BRIEF DESCRIPTION OF THE DRAWINGS

The drawings show the invention with reference to an embodiment in which.

DETAILED DESCRIPTION OF THE PREFERRED EMBODIMENTS

Figure 1:
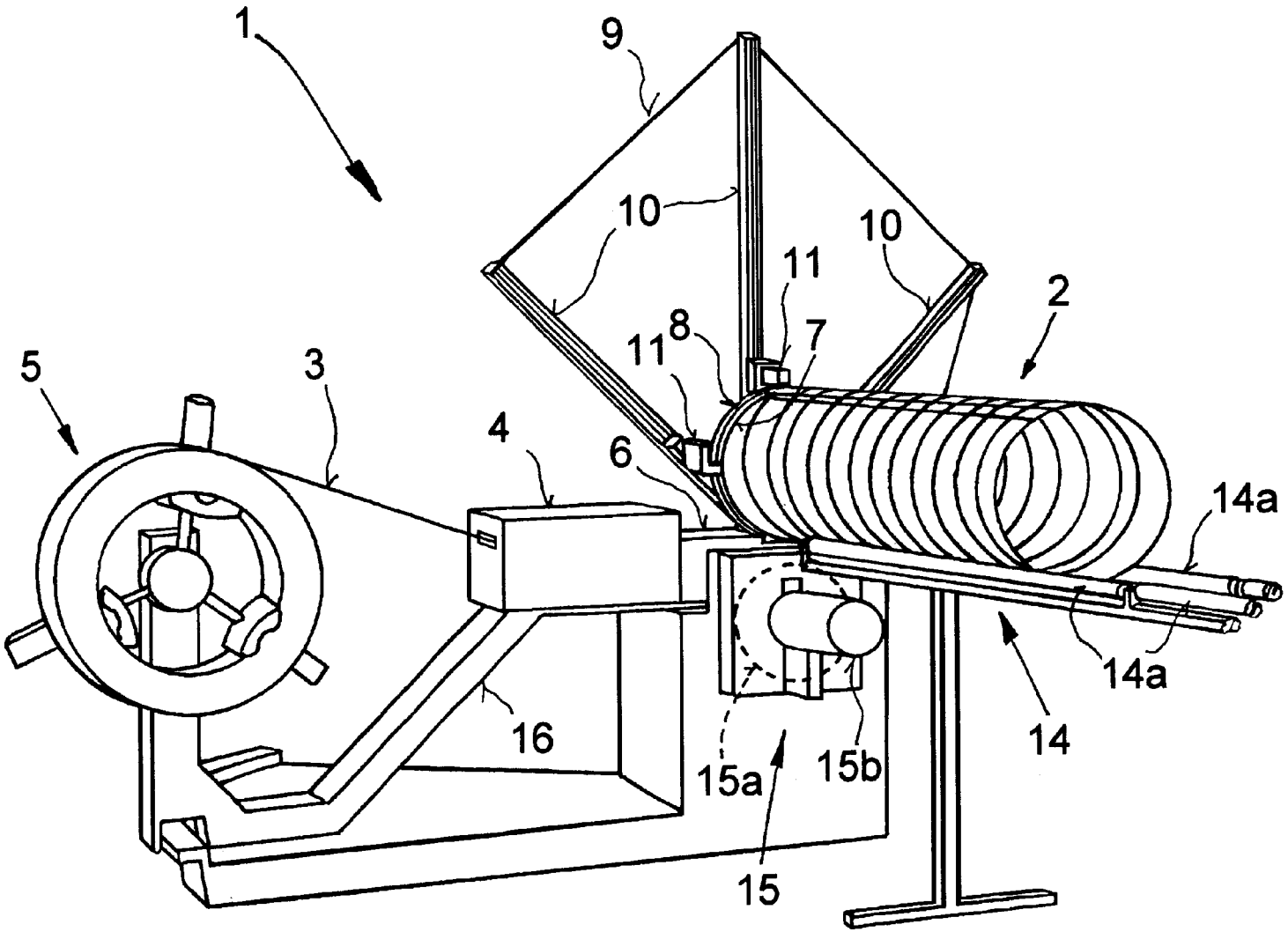
FIG. 1 is a perspective view of an apparatus for producing wrapped slip tubes.

FIG. 1 shows an apparatus (1) for producing wrapped slip tubes (2) from ribbon material (3). The apparatus (1) comprises a profiling device (4) for forming seamed edges in the ribbon material. To this end, the profiling device (4) comprises, for example, at least three, but preferably four pairs of profiling rolls not shown. For forming seamed edges, a particularly a simple rim on one side of the ribbon material and a double rim on the other side of the ribbon material, three profiling rolls are preferably used. In some cases, a pair of profiling rolls is shaped to form at least one reinforcing bead. Reinforcing beads are particularly suitable with specially thin ribbon material and/or with a large tube diameter. In order to render the formation of reinforcing beads selectable, preferably one roll of the pair of profiling rolls for forming reinforcing beads is removable or insertable with small expenditure. In order to wind the ribbon material 3 from an unwinding device 5, at least one pair of profiling rolls is driven by a drive unit not shown, but preferably all pairs of profiling rolls are driven. To advance the ribbon material without any problem, preferably one pair of profiling rolls for forming seamed edges is arranged as that pair of rolls which is passed by the ribbon material first. From the profiling device 4, the profiled ribbon material 3 gets via a guiding arrangement 6 having at least one guide surface into a bending device for deforming the ribbon material 3 by means of a deforming surface 7 into a helical partial surface of a cylindrical shell.

According to U.S. Pat. No. 4,567,742, a pair of special drive rolls, that are milled or knurled rolls, are used for advancing the ribbon material. These rolls lead, however, to damages of the surface of the ribbon material. By driving the profiling rolls according to a preferred embodiment of the invention, one can do without a separate pair of drive rolls so that additional damages are avoided. In order to achieve the necessary shearing force even with smooth profiling rolls, preferably all four pairs of profiling rolls are driven. Optionally, the profiling rolls too are plastic coated so that no metal dust can be produced upon moving the ribbon material through the pairs of profiling rolls.

In the embodiment shown, the deforming surface 7 is formed by the inner side of a forming ribbon 8 coated with plastic material. The ribbon material from the guiding arrangement 6 reaches the inner side of the forming ribbon 8 along which it moves due to the continued infeed and is, thus, bent. In order to keep the flexible forming ribbon 8 in the desired shape, a support device 9 is provided which supports the forming ribbon against any deformation from outside at at least two, but preferably three locations. To this end, three guiding profiles 10 are provided in the embodiment shown which lead away from the narrowest portion of the forming ribbon in different radial directions. For example, one guiding profile extends vertically to the top, while two other ones at both sides are arranged turned by an angle of substantially 45°. Bearing elements 11 may be secured to the guiding profiles 10 in correspondence with the tube diameter desired and the appropriate forming ribbon.

After the ribbon material 3 has been bent by 360° , the seamed edges of the two sides of the ribbon material having met each other are inserted into one another and closed by a seam closing device 12. For closing, the seamed edges inserted into one another are pressed together by cooperating pressing surfaces 13*a* of two closing rolls 13. For holding the wrapped slip tube 2 being produced, a bearing device 14 having rotatable supporting rollers 14*a* along an exit axis is provided. When the wrapped slip tube 2 has the desired length it is cut off by a cutting device 15, preferably comprising a cutting-off disk 15*a* and a driving motor 15*b*. It is to be understood that instead of a cutting-off disk 15*a* also a rotary shear or a thermal cutting device, such as a plasma or laser cutting device, could be used.

The unwinding device 5, the profiling device 4, the guiding arrangement 6 and the deforming surface 7 are arranged on a sustainer 16 which is pivotable relative to the exit axis and extends along a feeding axis so that the angle between the feeding axis and the exit axis may be adapted to the respective tube diameter.

The ribbon material that can be used consists of metal at least in part, particularly sheet metal or steel, a surface protection being achieved by a zinc layer, an oxide layer, a plastic coating or by using stainless metal, particularly stainless steel. Usually, a sheet metal will be used having a width of 137 mm and a thickness between 0.5 and 1 mm in correspondence with the tube diameter to be produced.

Figure 2:
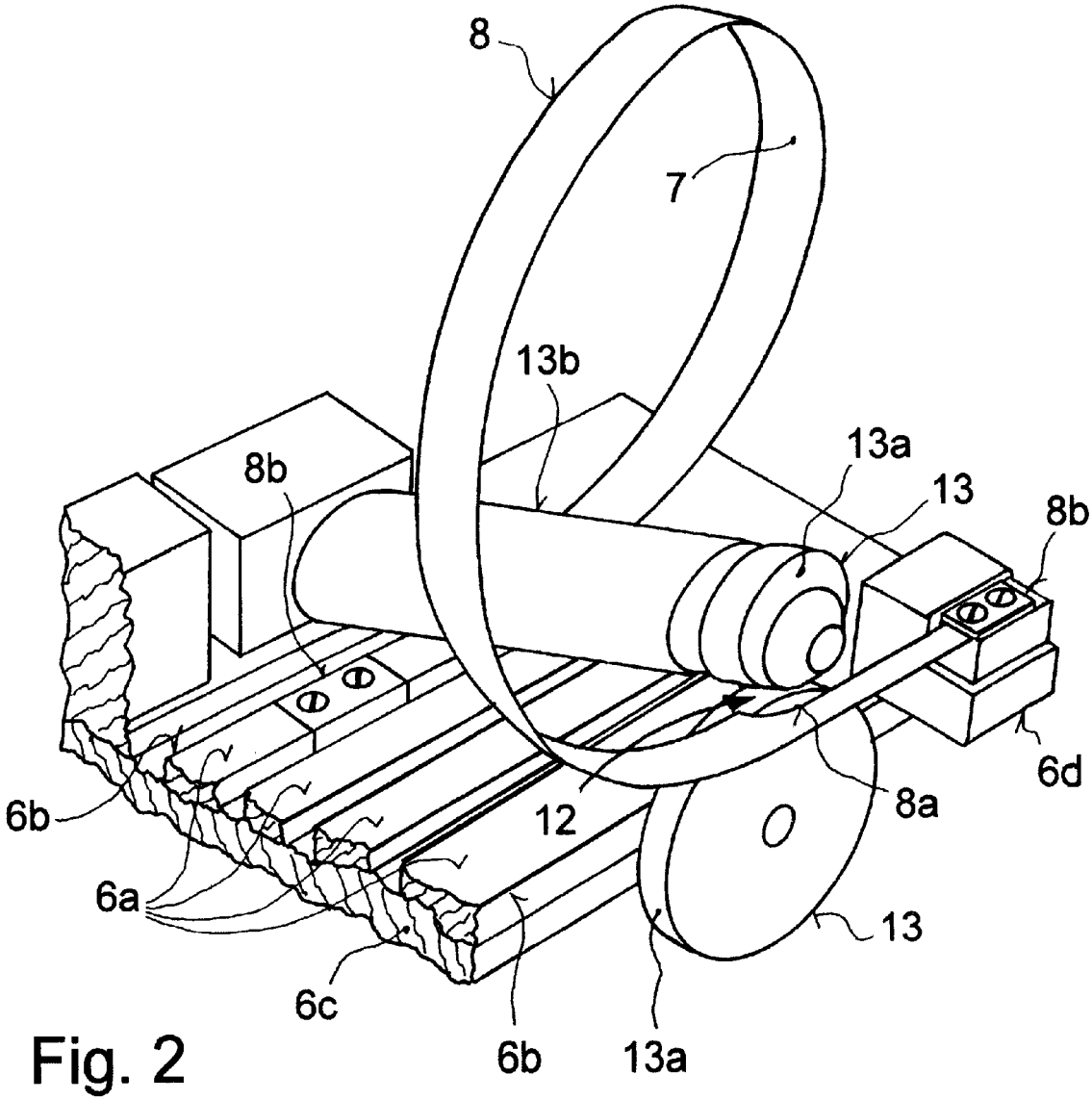
FIG. 2 is a perspective view of a bending device for deforming profiled ribbon material by means of a forming ribbon into a helical partial surface of a cylindrical shell.

FIG. 2 shows a detail of the guiding arrangement 6 as well as the forming ribbon 8 and the closing device 12. The guiding arrangement 6 comprises a supporting plate 6*c*, a first guiding surface 6*a* composed of partial surfaces wherein indentations extend in ribbon advancing direction between partial surfaces. These indentations can, in case, receive reinforcing beads of the ribbon material. In order to hold the ribbon material on the guiding surface 6*a*, a further guiding surface 6*a*, not shown, is provided in a space needed for the thickness of the ribbon material so that the ribbon material can be shifted into the forming ribbon while engaging the guiding surface. Since at least the surface of the first, and particularly also of the second guiding surface 6*a*, preferably however all rod elements between the first guiding surface 6*a* and the supporting plate 6*c*, consist of antifriction plastic material, production of metal dust can be prevented when the ribbon material moves aver the guiding surface. Since the ribbon material is bent immediately at the deforming surface 7 of the forming ribbon after its exit from the cooperating guiding surfaces, very high friction forces occur. Due to these high friction forces, mostly metallic materials have been used according to the prior art. This limitation to metallic guiding and deforming surfaces can be explained by the prejudice that only metals could be used due to the high forces and the intensive wear. Metal dust was only reduced by large quantities of lubricant. Surprisingly, it has been found that the above-mentioned antifriction plastics stand the high stress in forming ribbons.

At both sides of the first guiding surface 6*a*, lateral edges 6*b* are formed by which the lateral seamed edges of the ribbon material 3 are guided. One lateral edge of the forming ribbon 8 is arranged aligned with one of the lateral edges 6*b* and serves, thus, as a lateral guiding edge for one seamed edge when bending the ribbon material. After bending it by 360°, this lateral guiding edge of the forming ribbon 8 leads the respective seamed edge to the other seamed edge which is guided by the other lateral edge 6*b* of the first guiding surface 6*a*. Shortly before the seam closing device 12, one seamed edge is inserted into the other one, the forming ribbon comprising shortly before the insertion region a recess 8*a* which ensures unimpeded mutual insertion of the two seam edges. In addition, the seam closing device 12 is also situated within the region of the recess 8*a*.

On the supporting plate 6*c*, a holder 13*b* for holding a closing roll 13 is mounted, the holder extending through the forming ribbon 8 towards the tube produced. The other closing roll 13 is also rotatably mounted on the supporting plate 6*c*. In order to enable easy and precise mounting of the forming ribbon 8, connection blocks 8*b* are mounted at both ends of the forming ribbon 8 which may be connected either to the supporting plate 6*c* or a mounting member 6*d* located thereon. Connection is made preferably by two screws each, but any other connection is also conceivable. In some cases, the forming ribbon 8 is mounted on a connection block 8*b* in some adjustable manner so that the effective length off the forming ribbon 8 may be adjusted by some amount. By using a forming ribbon having a deforming surface of plastic material, one could reduce both rubbed off metal particles and scratching of the outer surface of the tube by scobs. Scobs are partially so deeply pressed into the plastic material that they do no longer produce perceivable scratches. The risk of scratching is also diminished by choosing a relative small width of the forming ribbon of substantially 25 mm. Preferred forming ribbons comprise a ribbon of spring steel coated with plastic material. the thickness of the ribbon of spring steel is in the range of 1–2 mm, preferably about 1.5 mm. The thickness of the plastic coating used is preferably within the range of 0.1–0.8 mm and particularly in the range of 0.2–0.4 mm. The length of the forming ribbon will be adapted to the diameter or the circumference of the tube to be produced.

In some cases, however, forming ribbons of plastic material, particularly of a monoplastic or a composite plastic material, are used. Composite materials comprise preferably glass fibers or carbon fibers and ensure also a high strength when in the form of a ribbon.

Figure 3:
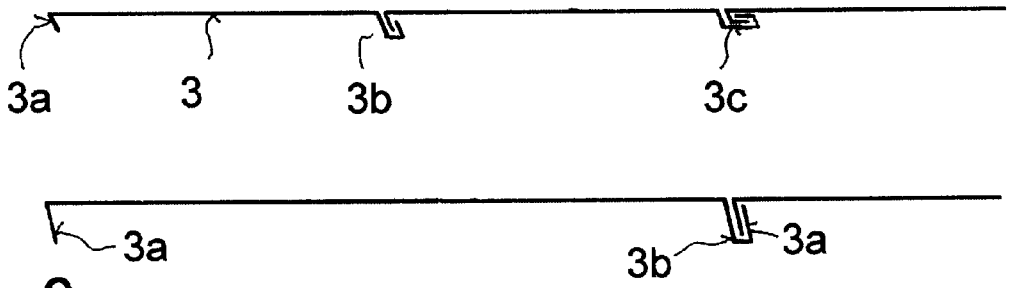
FIG. 3 shows two schematic cross-sections of a tube wall in the direction of the tube axis.

FIG. 3 shows in two schematic cross-sections of a tube wall in the direction of the tube axis how the two seam edges 3*a* and 3*b* are inserted into one another and may subsequently be closed to form a closed seam 3*c*.

We claim:

1. Apparatus for producing a wrapped slip tube of a desired diameter from ribbon material fed in along a feeding axis, while said wrapped slip tube exits along an exits axis, said feeding axis and said exit axis forming an angle therebetween, said ribbon material consisting of metal at least in part and having lateral edges, the apparatus comprising:

profiling means for deforming said lateral edges into seamed edges;

at least one guiding means for guiding said ribbon material when provided with said seamed edges;

bending means for deforming said ribbon material into a helical partial surface of a cylindrical shell and for interengaging said seamed edges, said bending means comprising:

a deforming surface formed on a flexible forming ribbon which has a contact surface for contacting said ribbon material, and said contact surface is made of plastic material, said forming ribbon joining said at least one guiding means for guiding the ribbon material provided with said seamed edges into a helical path thereby interengaging said seamed edges in cooperation with said guiding means;

seam closing device for closing said interengaged seamed edges by pressing said seamed edges together;

cutting means for cutting off produced portions of said tubes; and further comprising sustainer means substantially extending along said feeding axis being pivotally mounted for holding at least said profiling means, said at least one guiding means and said deforming surface being pivotable relative to said exit axis, said angle between the feeding axis and the exit axis is adaptable to the desired diameter by pivoting said sustainer means.

2. Apparatus as claimed in claim 1, wherein said plastic material of said plastic material of said contact surface is of an antifriction type.

3. Apparatus as claimed in claim 1, wherein said plastic material comprises at least one; polyamide such as polyamide 11; polyethylene such as polyethylene ionomere; chlorine trifluorethylene such as E-CTFE, polytetrafluroethylene (PTFE); and/or polyperfluorethylene-propylene (T.FEP).

4. Apparatus as claimed in claim 1, wherein said contact surface adheres to said forming ribbon.

5. Apparatus as claimed in claim 1, wherein said forming ribbon comprises a hardened spring steel.

6. Apparatus as claimed in claim 1, wherein said forming ribbon is a plastic material.

7. Apparatus as claimed in claim 1, further comprising exchangeable mounting means for exchangeably mounting said flexible forming ribbon to a bending device.

8. Apparatus as claimed in claim 1, wherein said bending means comprise support means for supporting said forming ribbon against deformation from outside at least at two locations.

9. Apparatus as claimed in claim 8, wherein said support means support said forming ribbon at three locations.

10. Apparatus as claimed in claim 1, further comprising bearing means along said exit axis for holding said wrapped slip tube which is being produced.

11. Apparatus as claimed in claim 10, wherein said bearing means comprise at least two rotatable supporting rolls.

12. Apparatus for producing a wrapped slip tube of a desired diameter from ribbon material fed in along a feeding axis, while said wrapped slip tube exits along an exit axis, said feeding axis and said exit axis forming an angle therebetween, said ribbon material consisting of metal at least in part and having lateral edges, the apparatus comprising:

profiling means for deforming said lateral edges into seemed edges;

at least one guiding means for guiding said ribbon material when provided with said seamed edges;

bending means for deforming said ribbon material into a helical partial surface of a cylindrical shell and for interengaging said seamed edges, said bending means comprising a deforming surface formed on a flexible forming ribbon which has a contact surface for contacting said ribbon material, and said contact surface is made of plastic material, said forming ribbon joining said at least one guiding means for guiding the ribbon material provided with said seamed edges into a helical path thereby interengaging said seamed edges in cooperation with said guiding means;

seam closing device for closing said interengaged seamed edges by pressing said seamed edges together; and cutting means for cutting off produced portions of said tube.

* * * * *